United States Patent [19]

Dubach

[11] Patent Number: 4,696,408

[45] Date of Patent: Sep. 29, 1987

[54] PLASTIC CLOSURE WITH SAFETY BAND

[75] Inventor: Werner F. Dubach, Maur, Switzerland

[73] Assignee: Alfatechnic AG, Switzerland

[21] Appl. No.: 883,615

[22] Filed: Jul. 9, 1986

[30] Foreign Application Priority Data

Jul. 23, 1985 [CH] Switzerland ..... 3189/85

[51] Int. Cl.[4] ..... B65D 41/46

[52] U.S. Cl. ..... 215/237; 215/235; 215/256

[58] Field of Search ..... 215/235, 237, 256, 254, 215/253; 220/276, 270, 266

[56] References Cited

U.S. PATENT DOCUMENTS 3,272,368 9/1966 Van Baarn ..... 215/235
3,441,161 4/1969 Van Baarn ..... 215/235
4,024,976 5/1977 Acton ..... 220/276
4,487,324 12/1984 Ostrowsky ..... 215/235 X

*Primary Examiner*—Donald F. Norton
*Attorney, Agent, or Firm*—Thomas W. Speckman; Ann W. Speckman

[57] ABSTRACT

A one piece plastic closure comprises a base which is attachable to a container and a cap attached to the base of the closure by a hinge. A safety band is molded together with the base, to which it may be attached by webs. The safety band overlays approximately half the perimeter of the cap and its height is generally the same as that of the cap itself. In this way, the cap cannot be grasped in the area opposite the hinge, and thus cannot be opened. A lug may additionally be provided on the cap which is engageable in a corresponding recess in the safety band to provide the closure in a closed and sealed condition, thus holding the closure and preventing it from opening under the effect of excess pressure in the container.

17 Claims, 11 Drawing Figures

Fig.1
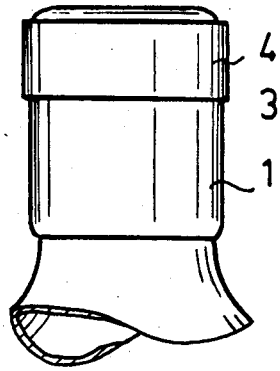
Fig.2
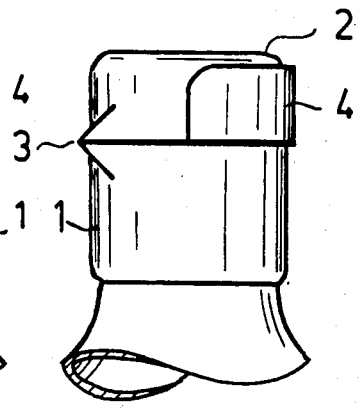
Fig.3
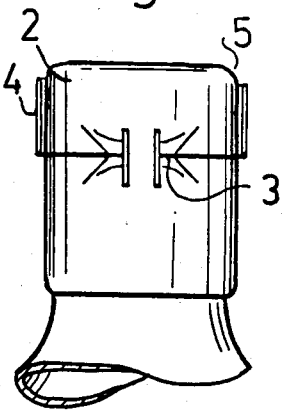
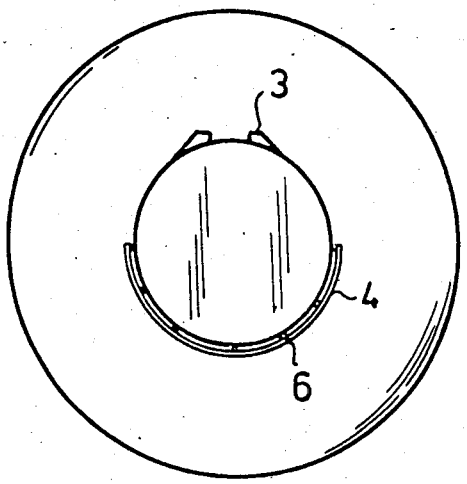
Fig. 4

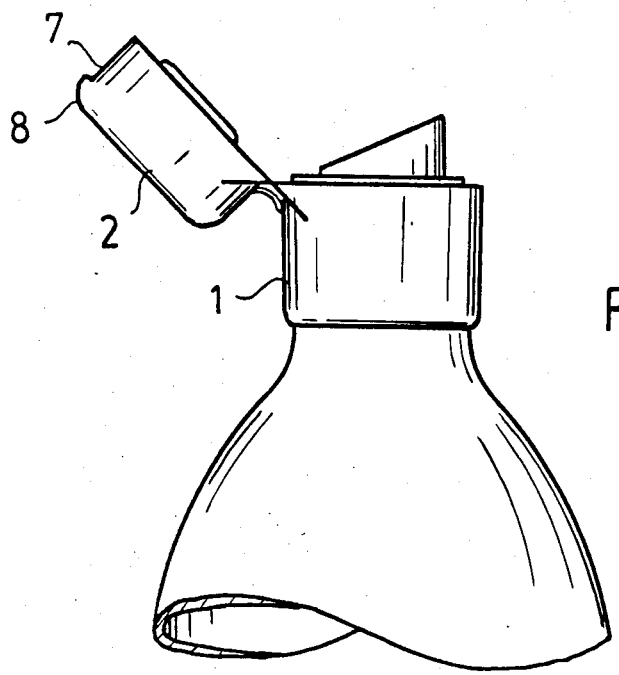
Fig. 5
Fig. 6
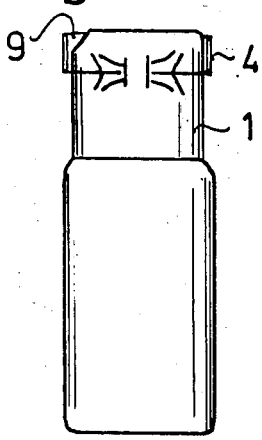
Fig. 7
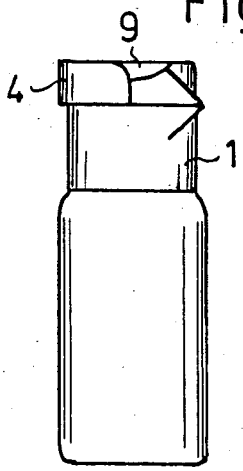
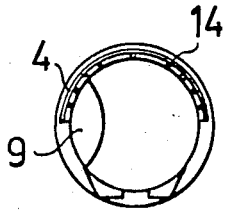
Fig. 8

PLASTIC CLOSURE WITH SAFETY BAND

BACKGROUND OF THE INVENTION

Safety bands provide a guarantee that products packed in containers provided with plastic closures have not been tampered with. In the past, safety bands have only been used on plastic closures consisting of two parts. In such instances where the plastic closure consists of a separate lower part and a cap which is placed on this lower part, the safety band is connected to the lower part by means of webs and encompasses the whole perimeter of the cap, that is to say, it surrounds the cap entirely.

Positive locking means arranged around the safety seal prevent the cap from being opened without the safety band being torn open first. The safety band may also be fastened to the cap itself and engage positively in the lower part of the closure. Finally, solutions are known whereby the safety band is molded in one piece with the lower part of the closure and extends high enough over it to prevent access to the cap before the safety band has been removed.

The subject of the present invention is a single piece plastic closure comprising a base and a cap connected to the base by means of a hinge together with a safety band provided on the closure base.

The problem with such arrangements is that when the cap is pivoted, the safety band is in the way. Recognition of this fact had led experts to consider one piece caps and especially snap closing caps to be unsuitable for applications where the product has to be warranted to be tamperproof.

SUMMARY OF THE INVENTION

An objective of the present invention is to provide a single piece plastic closure for containers comprising a base and a cap connected to the base by a hinge with a safety band which is particularly simple and cost effective.

This objective is met by a platic closure of the above type, characterized in that a safety band is provided on the base portion of the closure extending over the cap and overlaying not more than about half of the perimeter of the cap. In the area of the cap, the safety band extends approximately as high as the cap itself. The safety band is arranged symmetrically with respect to the hinge and is provided at the side of the cap opposite the hinge.

A closure of this type can be provided with a lug on the cap, projecting outwardly about the thickness of the safety band which, when the closure is in a closed condition, engages positively in a recess provided in the safety band. In an arrangement of this type, the safety band is able to absorb the pressure exerted on the cap in the direction of opening, such as may occur during transport or as a result of pressure differences. In this way, a snap fastening type of cap is capable of withstanding the pressures arising during pasteurizing or sterilizing processes without the need for any additional locking means.

In a further advantageous embodiment of the present invention, a lateral gripping depression may be formed in the surface of the cap. This depression enables the safety band to be grasped without the need to provide any additional tear tie. A further advantage of this embodiment is that the safety band which is secured in this way will tear downwards at an oblique angle, which tends to enhance the tearing force effect exerted on the material adjacent to the webs.

The cap of the plastic closure which is the subject of the present invention may be provided with a depression opposite the hinge fastening which is covered completely by the safety band when the closure is sealed, thus providing a simple means of aiding in opening the closure.

If the safety band is situated as close to the cap as possible, there is very little risk of unintentional damage to the safety band connected to the base of the closure by means of webs, the length of the webs being at least equal to the thickness of the material of the safety band itself.

The configuration of the safety band is such that when the safety band is torn open, a force perpendicular to the webs will always be exerted to detach the safety band. This force component exerts a considerable tearing effect on the webs by which the safety band is fastened to the base of the closure. This feature is surprising and allows use to be made of a plastic closure provided with a safety band made of polypropylene.

BRIEF DESCRIPTION OF THE DRAWINGS

The drawings show several embodiments of the subject matter of the present invention which will now be described in detail with the aid of the drawings, in which:

FIG. 1 shows a front view of a closure on a container provided with a safety band in a closed and sealed condition;

FIG. 2 shows a side view of the closure of FIG. 1;

FIG. 3 shows a rear view of the closure of FIG. 1;

FIG. 4 shows a top view of the closure of FIG. 1;

FIG. 5 shows a side view of the the closure of FIG. 1 in an open and unsealed condition;

FIG. 6 shows a rear view of a closure provided with a safety band on a container in a closed and sealed condition wherein the cap has a depression to facilitate opening;

FIG. 7 shows a side view of the closure of FIG. 6;

FIG. 8 shows a top view of the closure of FIG. 6;

DESCRIPTION OF PREFERRED EMBODIMENTS

Figure 9:
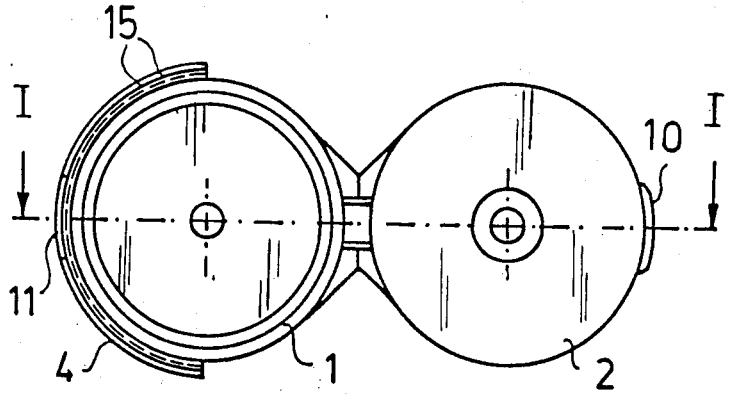
FIG. 9 shows another closure in an open condition, whereby a bottom view of the cap and a top view of the base are shown.

FIGS. 1–5 show different views of the same closure, wherein the sealing band is visible in FIGS. 1–4, and FIG. 5 shows the same closure without the sealing band. The closure comprises base 1, cap 2 and hinge 3 which connects the base and cap and allows them to pivot with respect to one another. A safety band 4 is molded to the base. Safety band 4 is provided opposite hinge 3 and extends approximately half way around the perimeter of the cap. Safety band 4 is symmetrically and oppositely positioned with respect to hinge 3. The height of safety band 4 roughly corresponds to that of cap 2. The top edge of cap 2 may be rounded and rounded shoulder 5 may extend below the upper edge of the safety band into the vertical, cylindrical side wall of the cap. It thus encompasses a small portion of the top edge zone of safety band 4. In this way, one end of the safety band can be gripped and torn away radially in a downward direction. Another way to remove the safety band consists of the user running a thumb diagonally across cap 2 away from hinge 3 and tearing safety band 4 away in a downward direction.

This way of unsealing and opening a container is particularly convenient if the closure is made of polypropylene. Due to its macromolecular structure, although polypropylene has a relatively high modulus of elasticity, it has a relatively low notched bar impact resistance. The configuration of the safety band, the connection of the band to the base of the cap by means of webs in conjunction with the absence of a tear strip all combine to exert a large tearing force on the material of the closure when the safety band is removed. This is the reason why a plastic closure provided with a polypropylene safety band can be used for the very first time in this instance. Webs 6 by which the safety band is connected to base 1 are shown in FIG. 4. They are located generally at the level of the separation between cap 2 and base 1 and are covered by safety band 4.

Cap 2 cannot be grasped without removing safety band 4 and the container can thus not be opened. Safety band 4 may also be used to cover a means for assisting opening of the closure. This can be seen in the embodiment shown in FIG. 5, in which the same closure is shown in an open condition, whereby the safety band has already been removed.

Means of facilitating opening the closure may comprise a recess forming recess channel 7 provided in the vertical side wall of cap 2. Rim 8 provided in the edge zone of cap 2 helps the user to apply upward pressure when opening the closure.

With smaller closures, removal of safety band 4 may present a problem, since it can be difficult to grip. A solution to this problem is shown in FIGS. 6–8. The cap is provided with a lateral cambered recess which extends along the edge of cap 2 and provides a gripping recess 9. The lateral arrangement of this recess insures that it is only partially covered by safety band 4 (FIG. 7). The presence of gripping recess 9, the top view of which is clearly shown in FIG. 8, allows the user to insert one finger behind the safety band, which can then be easily torn off. In addition, recess 9 which faces outward, also insures that sealing band 4 tears off in a downward and radial direction. Continuous seam 14 between safety band 4 and base 1 is visible in the top view of this embodiment.

Figure 10:
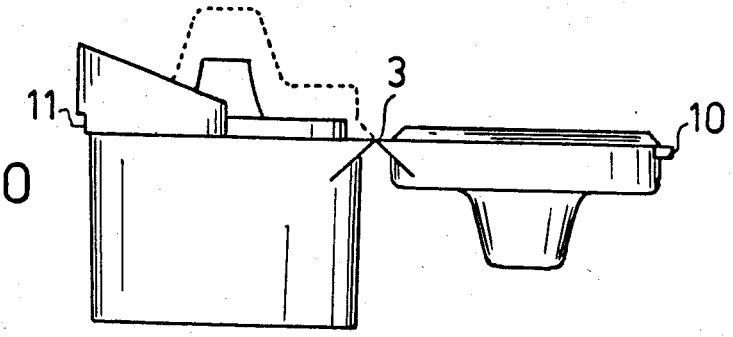
FIG. 10 shows a side view of the closure of FIG. 9.
Figure 11:
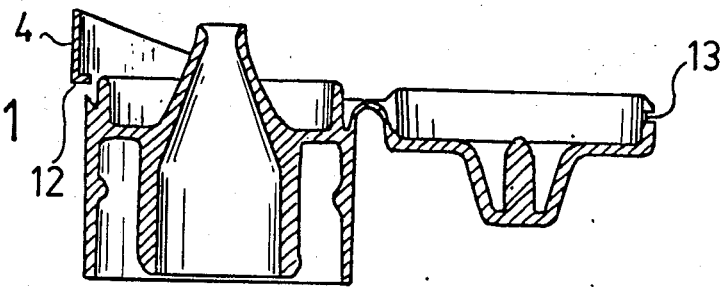
FIG. 11 shows a cross-sectional view of a closure in an open condition.

Another embodiment of the plastic closure provided with a safety band is illustrated in detail in FIGS. 9–11. The characteristics of the closure which are not essential to the present invention will not be described here. In FIGS. 9–11, the one piece closure is shown in a completely open condition, as it comes from the production mold. FIG. 9 shows a top view of base 1 of the closure and a bottom view of cap 2. Perforations 15 can be clearly seen by which safety band 4 is connected to base 1. The side of cap 2 opposite hinge 3 is provided with a lug 10. When the closure is in use, that is to say after safety band 4 has been removed, lug 10 serves to aid in opening the closure. Lug 10 projects beyond cap 2 by a distance slightly greater than the thickness of safety band 4. Recess 11 is provided adjacent the lower edge of safety band 4. When the closure is in a closed and sealed condition, lug 10 engages in recess 11, as shown by the dashed lines in FIG. 10. Once lug 10 is engaged in the recess 11, cap 2 can no longer be pivoted open without destroying the safety band.

The safety band is capable of absorbing considerable forces exerted on the cap by the container. Such forces will always occur when the closed container is subject to excess pressure. Such excess pressure is generated whenever a product has to be sterilized or pasteurized in a sealed container. No solution was found to this problem which arose in the past with plastic closures provided with snap fitting and hinges, unless additional locking arrangements were provided. However, closures with additional means of locking are inconvenient to handle and expensive to manufacture. A further merit of the present invention is that it provides a simple and low cost solution to this old problem.

The same result can also be achieved by providing the kinematic reverse of the above solution. The inner surface of the safety band may be provided with a projection 12 similar to lug 10 as shown in FIG. 11. This projection may be engageable in a corresponding recess 13 in cap 2, thus forming a closure which will be secure despite internal pressure.

It should finally be noted that the safety band and the closure may be connected by means other than webs. This connection may be established along the whole length by continuous seam 14 between these two parts which may be provided with weaker zones which are designed to yield, or alternatively with perforations 15.

I claim:

1. A single piece plastic closure for a container comprising a base (1) and a cap connected to said base by a hinge (3), characterized in that a detachable safety band (4) is detachably engaged with said base and overlays less than about half of the perimeter of said cap and extends approximately as high as said cap, said safety band (4) arranged symmetrically and oppositely with respect to said hinge (3), whereby said closure cannot be opened without detaching said safety band from said closure.

2. A plastic closure for containers according to claim 1, characterized in that said cap (2) is provided with at least one outwardly projecting lug (10), said safety band (4) is provided with at least one recess corresponding to said lug, and said lug is positively engageable in said recess (11) in said safety band (4) to provide said closure in a closed and sealed condition.

3. A plastic closure for containers according to claim 2, characterized in that said safety band (4) is connected to said base of said closure by means of webs, the length of said webs being approximately the thickness of said safety band.

4. A plastic closure for containers according to claim 2, characterized in that said closure is made of polypropylene.

5. A plastic closure for containers according to claim 1, characterized in that said cap (2) is provided with a lateral gripping recess (9) adjacent one end of said safety band (4).

6. A plastic closure for containers according to claim 5, characterized in that said safety band (4) is connected to said base of said closure by means of webs, the length of said webs being approximately the thickness of said safety band.

7. A plastic closure for containers according to claim 5, characterized in that said closure is made of polypropylene.

8. A plastic closure for containers according to claim 1, characterized in that a recess (7) is provided in a vertical side wall of said cap (2) opposite said hinge (3), whereby said recess (7) is covered by said safety band when the closure is in a closed and sealed condition.

9. A plastic closure for containers according to claim 8, characterized in that said safety band (4) is connected to said base of said closure by means of webs, the length of said webs being approximately the thickness of said safety band.

10. A plastic closure for containers according to claim 8, characterized in that said closure is made of polypropylene.

11. A plastic closure for containers according to claim 1, characterized in that said safety band (4) is connected to said base of said closure by means of webs, the length of said webs being approximately the thickness of said safety band.

12. A plastic closure for containers according to claim 1, characterized in that said closure is made of polypropylene.

13. A plastic closure for containers according to claim 1, characterized in that said safety band (4) is provided with at least one inwardly extending projection, said cap is provided with at least one recess corresponding to said projection, and said projection is positively engageable in said recess in said cap to provide said closure in a closed and sealed condition.

14. A plastic closure for containers according to claim 13, characterized in that said safety band (4) is connected to said base of said closure by means of webs, the length of said webs being approximately the thickness of said safety band.

15. A plastic closure for containers according to claim 13, characterized in that said closure is made of polypropylene.

16. A plastic closure for containers according to claim 1, characterized in that said base of said closure and said safety band are connected by a continuous seam having weaker zones which act as breaking points.

17. A plastic closure for containers according to claim 1, characterized in that said base of the closure and said safety band are connected by a continuous seam having perforations.

* * * * *